US005699901A

United States Patent [19]

Cohen

[11] Patent Number: 5,699,901

[45] Date of Patent: Dec. 23, 1997

[54] JEWELRY DISTRIBUTION AND DISPLAY

[75] Inventor: Richard M. Cohen, Foxboro, Mass.

[73] Assignee: Swarovski Jewelry U.S. Limited, Cranston, R.I.

[21] Appl. No.: 623,851

[22] Filed: Mar. 26, 1996

[51] Int. Cl.[6] ..... B65D 73/00

[52] U.S. Cl. ..... 206/6.1; 206/779; 206/495

[58] Field of Search ..... 206/6.1, 485, 775, 206/779, 780, 486, 495, 557, 561, 566, 806

[56] References Cited

U.S. PATENT DOCUMENTS

| | | | |
|---|---|---|---|
| 3,989,154 | 11/1976 | Walklet . | |
| 4,025,039 | 5/1977 | Croll et al. | 206/485 X |
| 4,281,469 | 8/1981 | Feibelman . | |
| 4,457,432 | 7/1984 | Solheim . | |
| 4,461,384 | 7/1984 | Erlam | 206/485 X |
| 4,619,363 | 10/1986 | Wolfseder . | |
| 4,671,407 | 6/1987 | Brutosky . | |
| 4,697,705 | 10/1987 | Garganese . | |
| 4,944,389 | 7/1990 | Robertson | 206/6.1 |
| 5,074,409 | 12/1991 | Elkin . | |
| 5,197,596 | 3/1993 | Garganese . | |
| 5,261,529 | 11/1993 | Holland . | |
| 5,273,153 | 12/1993 | Braun . | |
| 5,353,921 | 10/1994 | Tyra . | |

*Primary Examiner*—Jacob K. Ackun
*Attorney, Agent, or Firm*—Salter & Michaelson

[57] ABSTRACT

An apparatus for the display of articles includes a generally planar slug including a body having a front surface with an indicia display area, and openings formed therein for attaching the article to the body in a position that the article is displayed on the front surface of the body. The apparatus further includes a generally planar slug holder capable of attaching the slug thereto, the slug holder including a body having a front surface with an indicia display area which extends beyond the periphery of the indicia display area of the slug upon attaching the slug to the slug holder. Alignment flanges and tabs, associated with at least one of the slug and slug holder, align the slug with the slug holder. Two-sided adhesive tape is provided for attaching the body of the slug to the body of the slug holder.

13 Claims, 12 Drawing Sheets

JEWELRY DISTRIBUTION AND DISPLAY

TECHNICAL FIELD

The technical field of this invention concerns devices and methods used in the distribution and display of jewelry and similar articles.

BACKGROUND OF THE INVENTION

Fashion and fine jewelry and similar articles are marketed attached to cards or in gift boxes for display and merchandising. The cards and boxes may be marked, labelled or identified with the name or trademark of the jewelry designer, manufacturer or retailer, and descriptions of the nature, quality, price and item code of the jewelry. A manufacturer or distributor may sell identical pieces of jewelry to different retailers. Each retailer usually has unique marking, labeling, identification or description requirements. Retailers expect properly marked, labeled, and described jewelry delivered on short notice.

Manufacturers generally transfer jewelry and similar articles to distributors wrapped in plastic or tissue paper. These products are fragile and irregular in size and shape and ordinarily cannot be handled by automated means. Distributors frequently print numerous types of display cards in small quantities, and assemble jewelry by hand onto cards based on estimated retailer demand. If actual demand varies from estimated demand, jewelry must be removed from cards by hand and reassembled by hand on different cards. Jewelry also must be disassembled and recarded when products are discontinued or sold as overstock. Distributors must maintain either a large inventory of product specifically carded for multiple retailers, or a large work force to uncard and recard the product. Large inventories and large work forces are expensive, as is the need to print numerous types of cards in small quantities.

The inefficient, costly and labor intensive process described above is nearly universal. One inventor described a removable identification panel friction fit on a card in U.S. Pat. No. 4,281,469, but this method has not found commercial acceptance, presumably because the labeling may not convey the high quality marketing image generally necessary in retailing fashion and fine jewelry, and the friction fit method may limit the size of the marking and labeling.

SUMMARY OF THE INVENTION

This invention solves the technical problems of the uneconomic and inefficient distribution and display of jewelry and similar articles with a slug, slug holder and slug tray distribution system. Jewelry is attached to a slug which can be marked with indicia descriptive of the jewelry, but other labeling, marking, identification and entity specific branding is omitted, permitting costs efficiencies in printing slugs in large quantities.

Slugs may be loaded into stackable interlocking slug trays suitable for automated handling, or stored by more conventional means such as in boxes, bins or bags stored in racks or on shelves. Upon receipt of retailers' orders, slugs are assembled with slug holders which have been preprinted with retailer specific labeling, branding and identification.

The slug and slug holder method separates the product identification and retailer branding functions, permitting economies of scale in purchasing slugs and slug holders. The invention also avoids the costly alternatives of high inventory or a larger work force by eliminating routine uncarding and recarding common to current distribution methods. The invention also permits less costly, more accurate and faster automated handling of product on slugs, and avoids the lower quality appearance created by stick-on labels, removable inserts, and similar branding and marking methods.

BRIEF DESCRIPTION OF DRAWINGS

The drawings are briefly described as follows.

DETAILED DESCRIPTION OF THE BEST MODE FOR CARRYING OUT THE INVENTION

Figure 1:
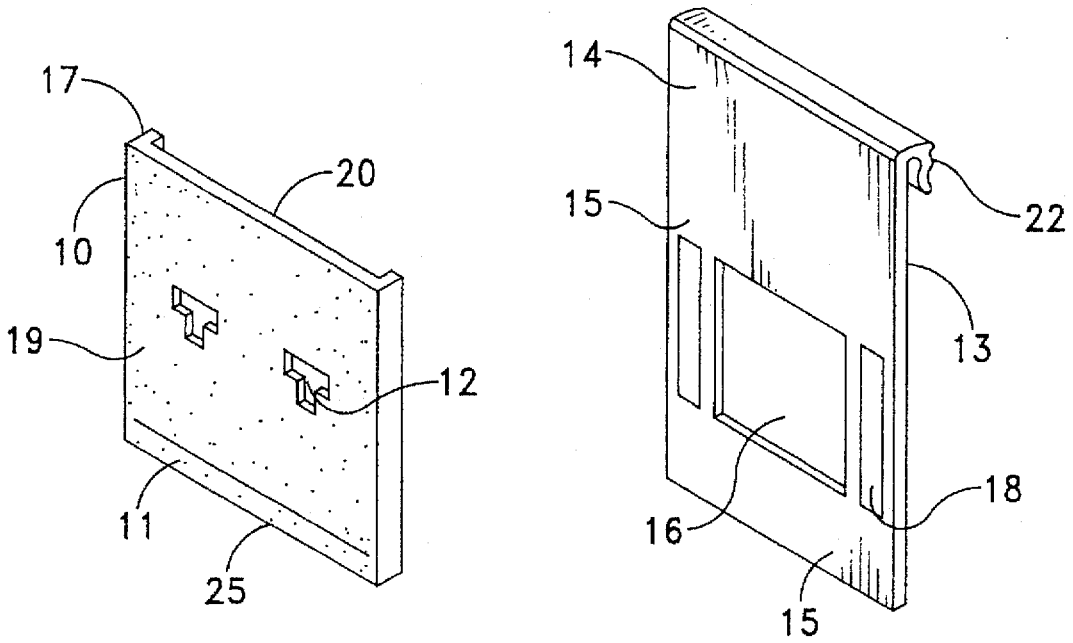
FIG. 1 is a perspective view of an unassembled slug and hanging slug holder.
Figure 2:
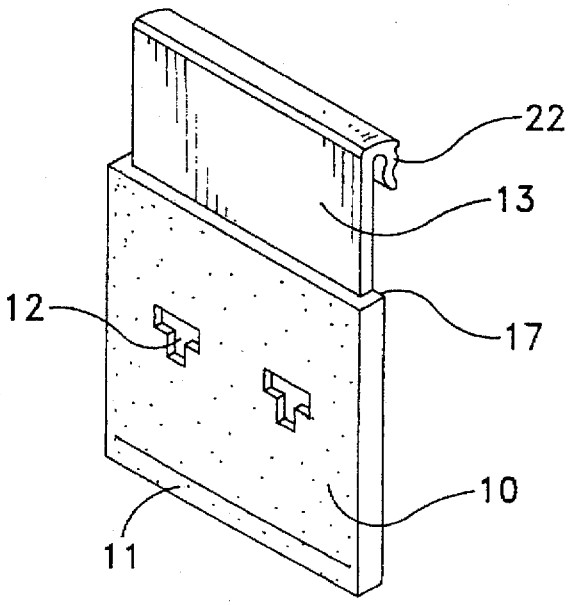
FIG. 2 is a perspective view of an assembled slug and hanging slug holder.
Figure 3:
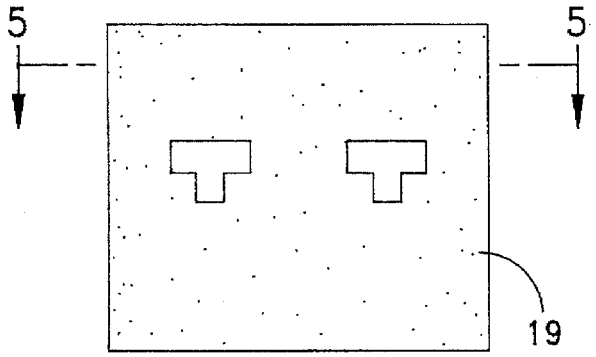
FIG. 3 is a front plan view of a slug.
Figure 4:
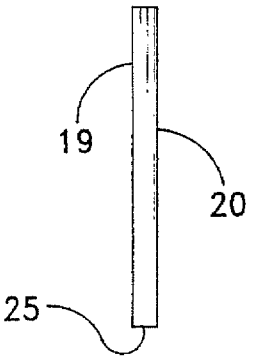
FIG. 4 is a side plan view of a slug.
Figure 5:
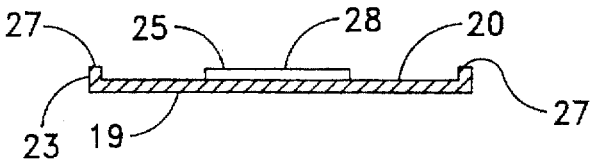
FIG. 5 is a top plan view of a slug.

As shown in FIGS. 1 and 5, the slug and slug holder jewelry distribution and display apparatus comprises a slug 10 with an indicia display area 11 and a jewelry attaching means 12, a slug holder 13, with an indicia display area 14, an attachment area 15, and a product back projection area 16, alignment means 27, 28, and means for attaching the slug to the slug holder 18. The slug and slug holder distribution apparatus can be used separately or in conjunction with the slug tray system, FIGS. 18, 19, 24, and 25.

The slug (10) can be any shape, but preferably will be rectangular. The slug is generally planar and preferably will be made of extruded plastic, but can be molded, cut or manufactured in other known ways from paper, paperboard, metal, glass, wood or stone. The slug ordinarily would be covered with flocking, decorative paper, foils, or cloth as is common in jewelry display devices, but covering is not an element of the invention.

The slug has a jewelry attaching means (12), which can be any of the many well known methods for attaching jewelry to cards such as holes for earring wires, posts and clips, broach pins and tacks, and pendant posts, tabs for hoop earrings, and star punch configurations.

The jewelry attaching means may be located anywhere on the slug face 19, provided that any portion of the jewelry or jewelry attaching means protruding through the slug back 20 protrudes through the product back projection area (16) of the slug holder. The jewelry attaching means ordinarily will be located on the slug so that the jewelry will appear aesthetically pleasing when the slug and slug holder are assembled and displayed. This frequently means that the jewelry attaching means provides for centering the jewelry on the slug if the product is a single item, or equal spacing on the slug if the product has multiple items, such as a pair of earrings.

As shown in FIG. 1, the slug also has one or more slug indicia display areas (11) on the slug face. Use of this area is optional, but it frequently will be used to display product specific information such as gold content and other descriptions of the product. The slug indicia display area may be covered with the same material as the slug face, or with a different or no material, and should be made of or covered with a material compatible with any marking, printing or labeling used.

Several alternative versions of the slug (10) are shown in FIGS. 1, 10, 11, 13, 14 and 15. These versions differ primarily in shape and alignment and attachment means, and are described more fully below.

The slug holder is generally planar and as shown in FIGS. 1, 6, 8, 9, 10, 11, 13, 14 and 15 is either a hanging slug holder (13) or a box insert slug holder (21). The slug holder has one or more indicia display areas (14) suitable for appropriate printing or other marking, branding or identification. The product back projection area (16) is an area where the material of the slug holder has been removed by die cutting or other conventional means, or where material is not formed when the slug holder is manufactured. The product back projection area is of a size that it does not conflict with any product, jewelry, or jewelry fastening means projecting through the slug back (20).

Figure 7:
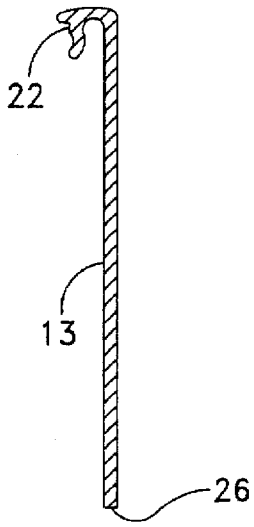
FIG. 7 is a side plan view of a hanging slug holder.
Figure 8:
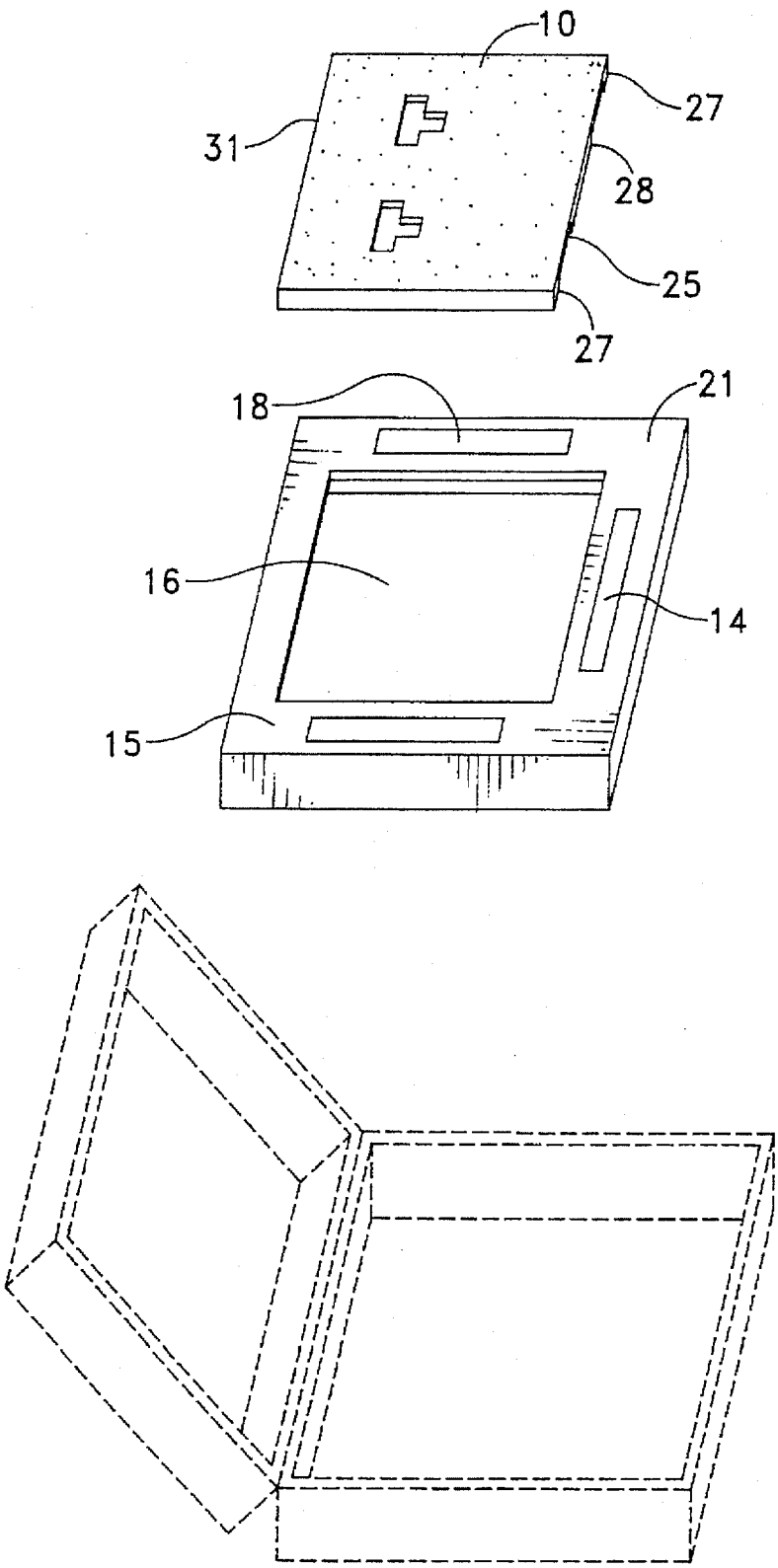
FIG. 8 is an exploded perspective view of a slug and a rectangular slug holder, with broken lines showing an associated rectangular gift box for illustrative purposes only and forming no part of the claimed invention.
Figure 9:
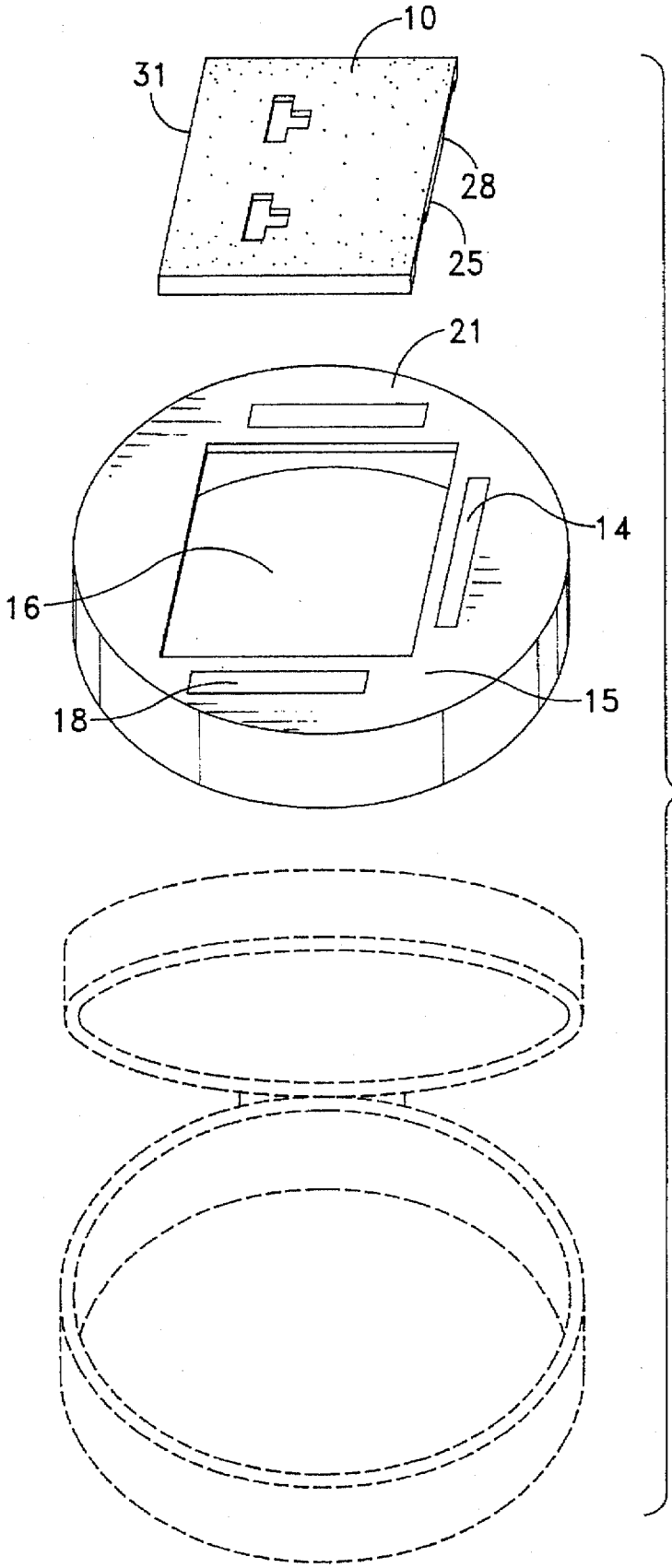
FIG. 9 is an exploded perspective view of a slug and an oval slug holder, with broken lines showing an associated oval gift box for illustrative purposes only and forming no part of the claimed invention.

As shown in FIGS. 1 and 7, the hanging slug holder has a hanger 22, alternative versions of which are well known in the art and, as shown in FIG. 7, generally comprise projecting flanges that permit vertical hanging of the hanging slug holder.

Figure 6:
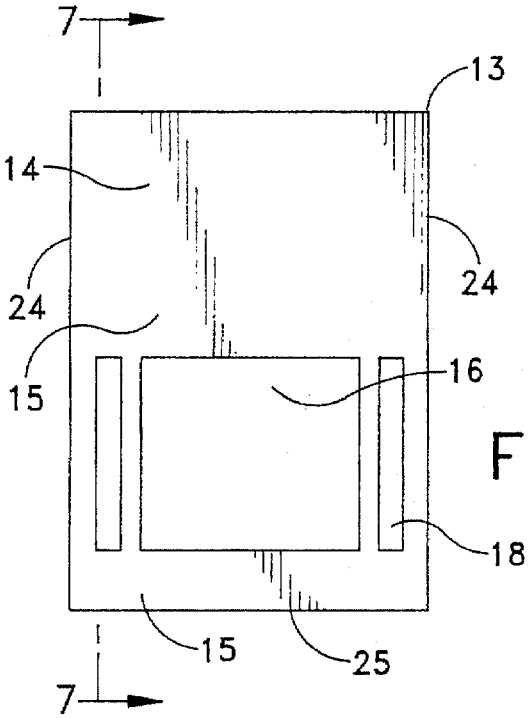
FIG. 6 is a front plan view of a hanging slug holder.

As shown in FIGS. 1 and 6, slug holders also have one or more slug holder attachment areas (15) for attaching the slug and slug holder. As shown in FIGS. 1, 8, 9, 10, 11, 13, 14 and 15 slug holder attachment areas (15) vary in size and location depending on the attachment means and variations in the slug holders. Slug holder attachment areas must be large enough to accommodate the attachment means used, must not interfere with the slug holder indicia display area (14) or the product back projection area (16), and usually are covered by the slug when the slug and slug holder are attached.

Several alternative versions of the slug holder are shown in FIGS. 1, 8, 9, 10, 11, 13, 14 and 15. These versions differ primarily in shape and alignment and attachment means and are described more fully below.

Figure 10:
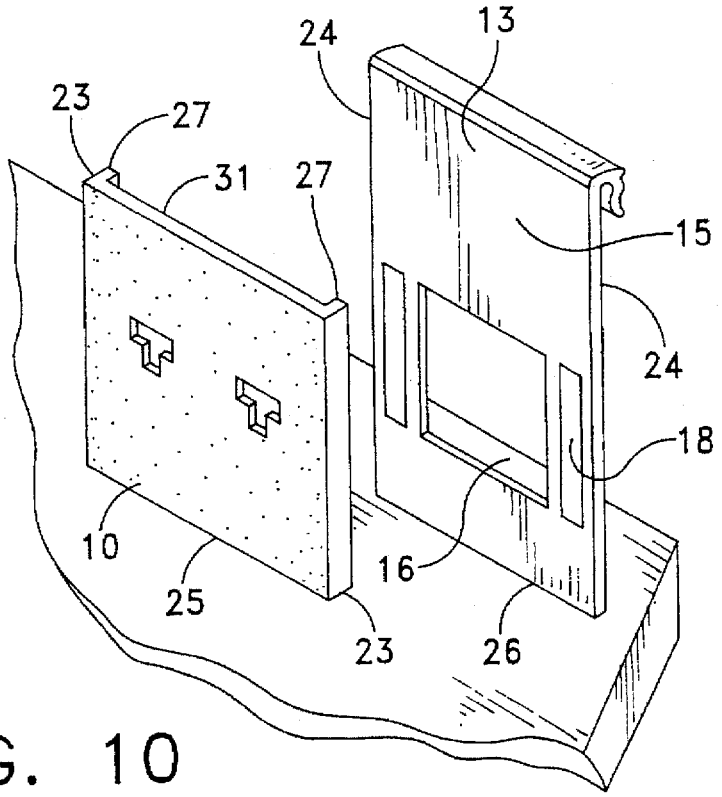
FIG. 10 is a perspective view of an alternative unassembled slug and hanging slug holder.
Figure 11:
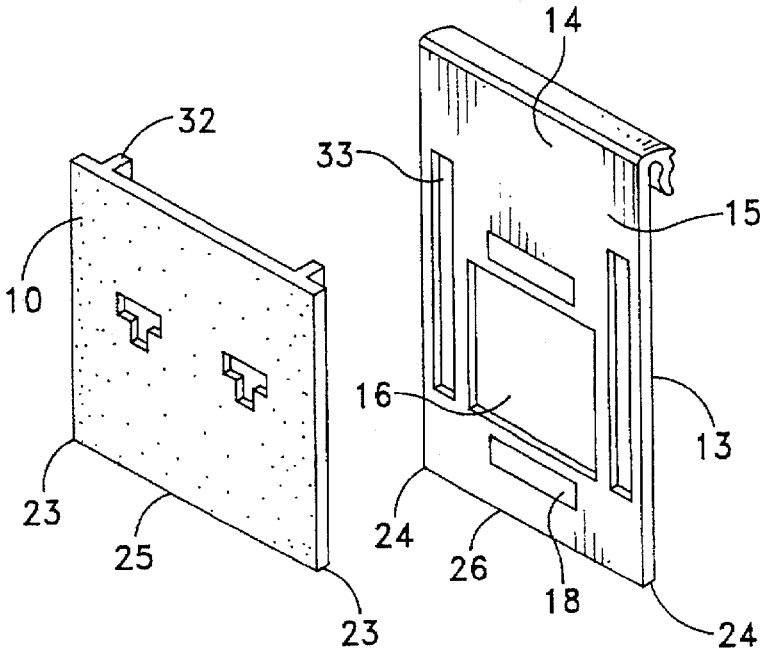
FIG. 11 is a perspective view of an alternative unassembled slug and a hanging slug holder.

The alignment means aligns the slug and slug holder so that the combined slug and slug holder is aesthetically pleasing. There are a variety of alignment means, and the precision of alignment necessarily varies with different slug shapes and alignment means. For rectangular shaped slugs approximately the same width as the slug holder, alignment should result, as shown in FIGS. 10 and 11, in the slug opposing edges 23 approximately parallel to and even with the respective slug holder opposing edges 24, and the slug bottom 25 approximately parallel to and even with the slug holder bottom 26. Additional alignment parameters may be applicable to different slug and slug holder versions, as described below.

The alignment means shown in FIGS. 1, 2, 3, 4, 5, 8 and 9, as shown in FIG. 5, comprises a flange 27 on each of the two slug opposing edges, the flanges projecting from and approximately perpendicular to the slug back (20), and a tab 28 at the slug bottom projecting away from and approximately perpendicular to the slug back. The flanges and tab may be of any minimum length, as measured along the slug opposing edges or slug bottom from which they project, provided that length includes enough material so that the flange or tab is strong enough to resist breaking during alignment, and such lengths usually are no greater than the respective slug opposing edges or slug bottom from which the flanges and tab project. The flanges and tab may project from the slug back any aesthetically acceptable depth, provided that the slug can be aligned on the flanges and tab, but the flanges and tab usually will project a distance approximately equal to the thickness of the slug holder.

Figure 12:
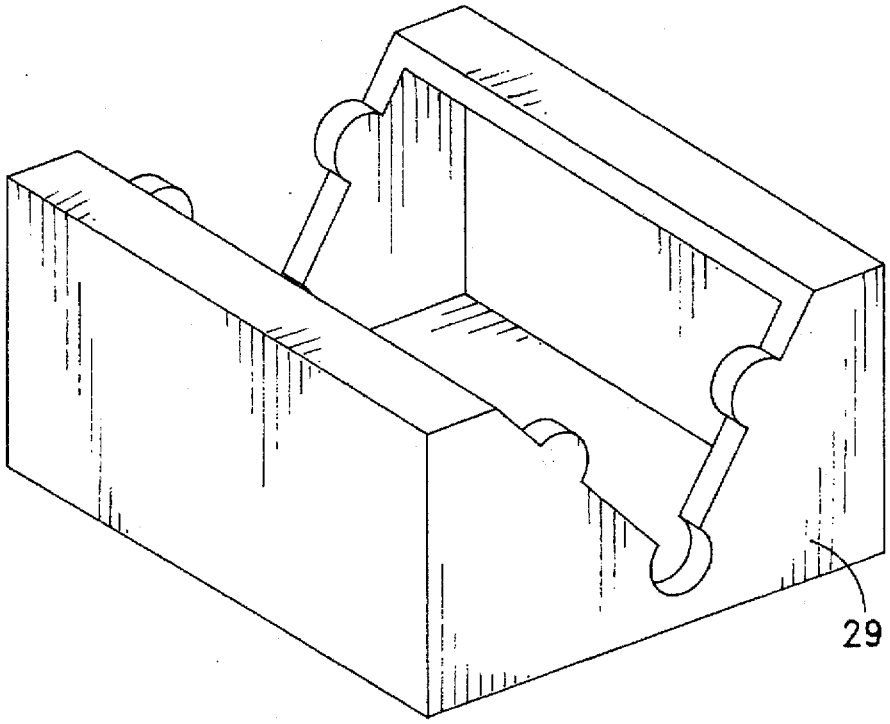
FIG. 12 is a perspective view of a jig used in aligning a slug and slug holder.

The alignment means shown in FIG. 10 is similar to that shown in FIG. 1, except there is no tab (25) as shown in FIG. 5 at the slug bottom. The slug opposing edges are aligned by flanges, but the slug bottom and slug holder bottom are aligned by placing the slug and slug holder on a flat surface, such as a work bench or table, or in a jig 29, such as is shown in FIG. 12. The flat surface or jig preferably will have an area into which jewelry or product which projects below the bottom edge of the slug can hang while alignment occurs.

Figure 13:
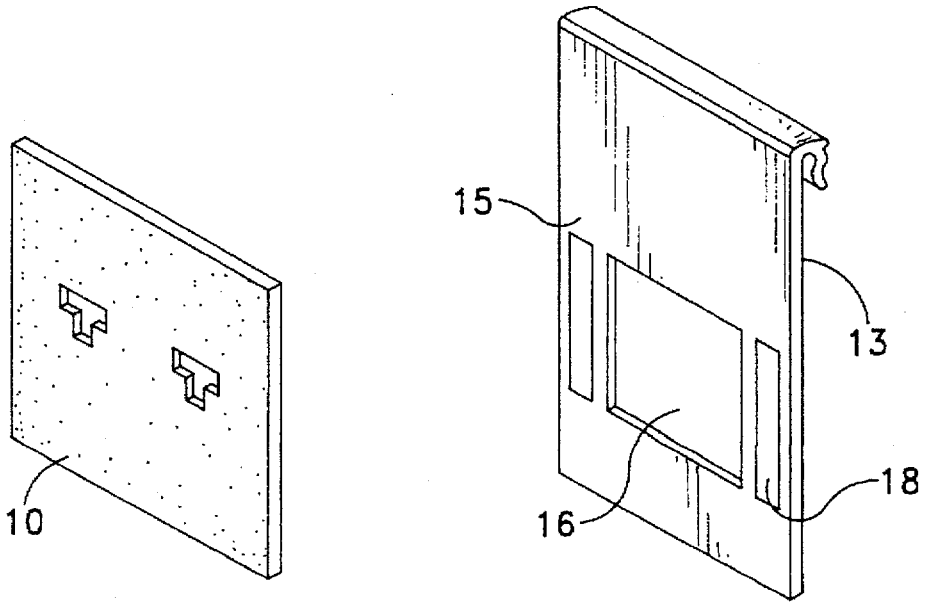
FIG. 13 is a perspective view of an alternative unassembled slug and hanging slug holder.

The alternate alignment means shown in FIG. 13 is the same as in FIG. 10 except there are no flanges (27). The slug and slug holder shown in FIG. 13 are aligned on a flat surface, jig or by hand at both the slug bottom and slug holder bottom, and at the slug opposing edges and the slug holder opposing edges.

Figure 14:
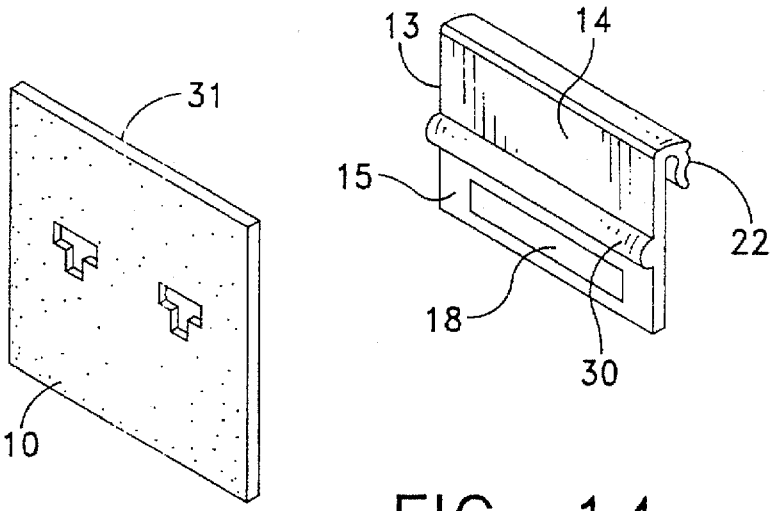
FIG. 14 is a perspective view of an alternative unassembled slug and hanging slug holder.

FIG. 14 shows another alternative alignment means comprising a slug holder ridge 30 projecting from the slug holder face a distance equal to approximately the thickness of the slug. The ridge is parallel to the slug top 31 and ordinarily extends between the opposing slug holder edges, though a shorter ridge will perform the alignment function and is acceptable if it is aesthetically satisfactory. This version of the slug holder has no defined product back projection area (16), since the slug face does not extend beyond the attachment area (15). Other slug holder versions could terminate before the product back projection area.

FIG. 11 shows another alternate alignment means comprising a plurality of rails 32 projecting perpendicular from and attached to the slug back, and an equal number of rail slots 33 in the slug holder, the rail being slightly shorter and narrower than the rail slots, so that when the rails are inserted into the corresponding rail slots the slug opposing edges (23) and slug bottom (25) align with the respective slug holder opposing edge (24) and slug holder bottom (26). Vertical rails and rail slots are located between the slug opposing edges and the product back projection area (16), so as not to impinge on the product back projection area. Rails and rail slots also may be alternatively or additionally located parallel to the slug bottom and slug holder bottom and to the slug top and slug holder top, if located so not to impinge on the slug holder indicia display area (14), the product back projection area, or any other rail or rail slot.

Figure 15:
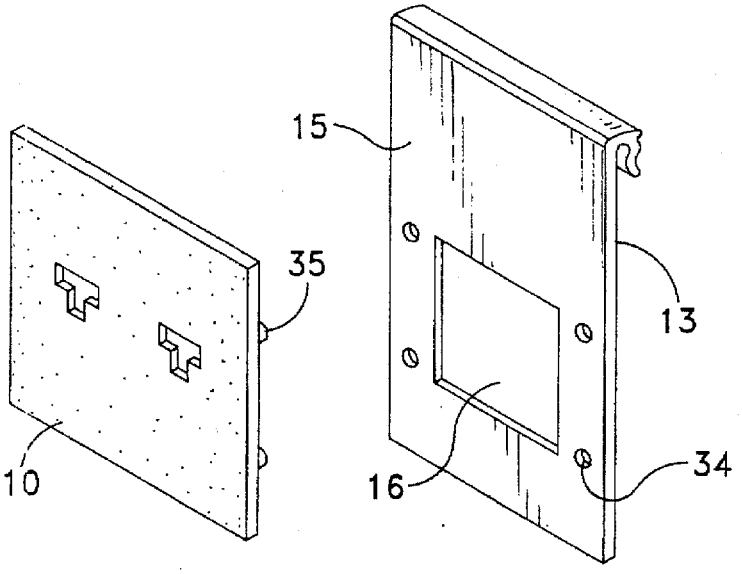
FIG. 15 is a perspective view of an alternative unassembled slug and a hanging slug holder which are aligned and attached by a pin means.
Figure 16:
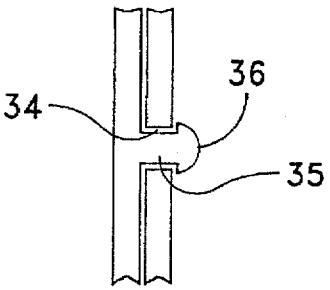
FIG. 16 is a detail of the pin means with a pin head.
Figure 17:
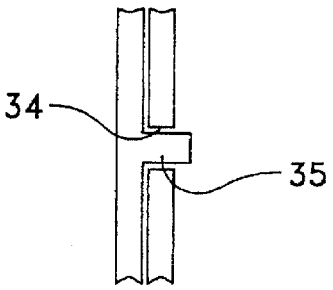
FIG. 17 is a detail of the pin means with no pin head.

FIG. 15 shows another alternate alignment means comprising a slug holder with a plurality of pin holes 34 located on the slug face between the slug holder indicia display area and the slug holder bottom, and the slug holder opposing edges, and not within the product back projection area, and slug pins 35 attached to and projecting approximately perpendicular to the slug back (20) so that when the slug pins are aligned with the pin holes on the slug holder, the slug bottom and slug holder bottom and the slug opposing edges and slug holder opposing edges are aligned. As shown in FIG. 16, the pin (35) may have a pin head 36 at the end of the pin, the diameter of the pin head being larger than the pin diameter and larger than the pin hole diameter so that when the pin head, which is made of a flexible or elastic material, is forced through the pin hole, the pin head prevents separation of the slug and the slug holder. Alternatively, as shown in FIG. 17, pins without pin heads could be used as alignment means, with any of the attachment means discussed herein to prevent separation of the slug and slug holder.

The attachment means (18) attaches the slug and slug holder in an aesthetically acceptable manner, to avoid noticeable gaps or spaces between the opposing edges of the slug and slug holder. The attachment means varies for the different alternative alignment means described above. The attachment means also should be selected considering changes in temperature, sunlight and other environmental conditions to which the attachment means will be subjected, before and after attachment occurs. The attachment means selection also should consider ease of handling, time required after for the attachment means to set, harden, or effectively attach, initial contact, the relative performance of the attachment, and environmental hazards generated by the attaching means. The attachment means may be attached to the slug, or to the slug holder during their respective manufacturing, or may be kept separately and inserted between the slug and slug holder as they are assembled.

The attachment means (18) for the slug and slug holder, as shown in FIGS. 1, 6, 8, 9, 10, 11, 13 and 14, include foam tape, double faced tape, glue, heat set adhesives, heat welding, plastic solvent welding, friction fit, and other common methods of joining the particular materials used. These methods can be used separately, or in conjunction with other attachment means.

The attachment means for the slug and slug holder shown in FIGS. 13 and 14 include all of the above means except friction fit.

The attachment means for the slug and slug holder shown in FIGS. 11 and 15 is intended to be primarily friction fit or welded for slug and slug holders made from plastic and for FIG. 15, the pin head and pin hole system, but could include all of the attachment means described above with reference to attachment means for FIGS. 1, 2, 3, 6, 8, 9, 10, 11, 13 and 14.

For all slugs and slug holders, in certain attachment means, such as friction fit or welding, the material used in the alignment means also may serve as a component of the attachment means.

Figure 18:
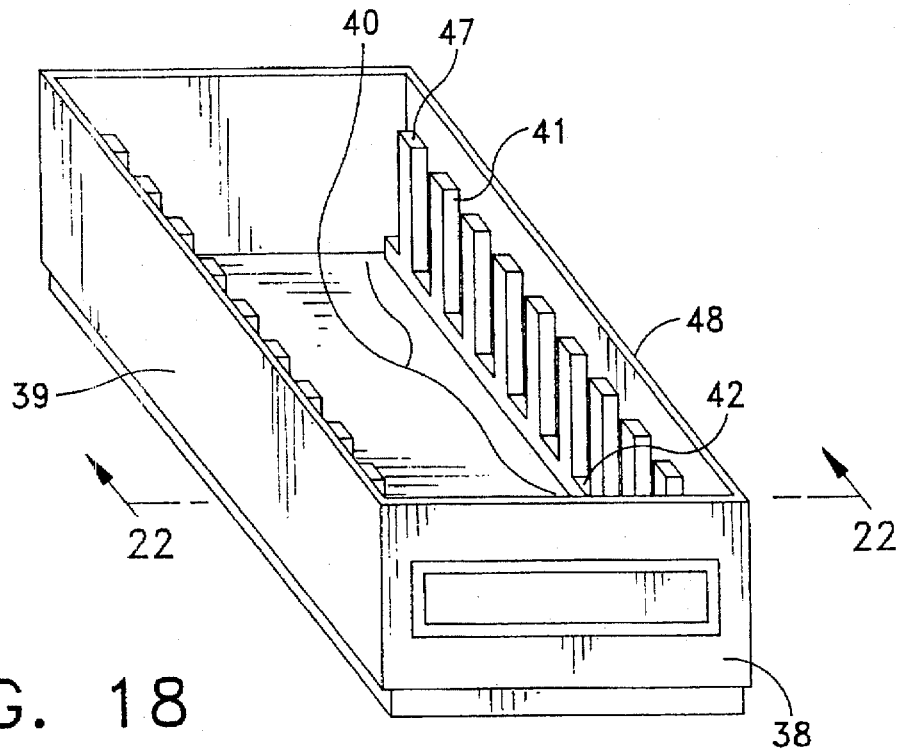
FIG. 18 is a perspective view of a slug tray.
Figure 19:
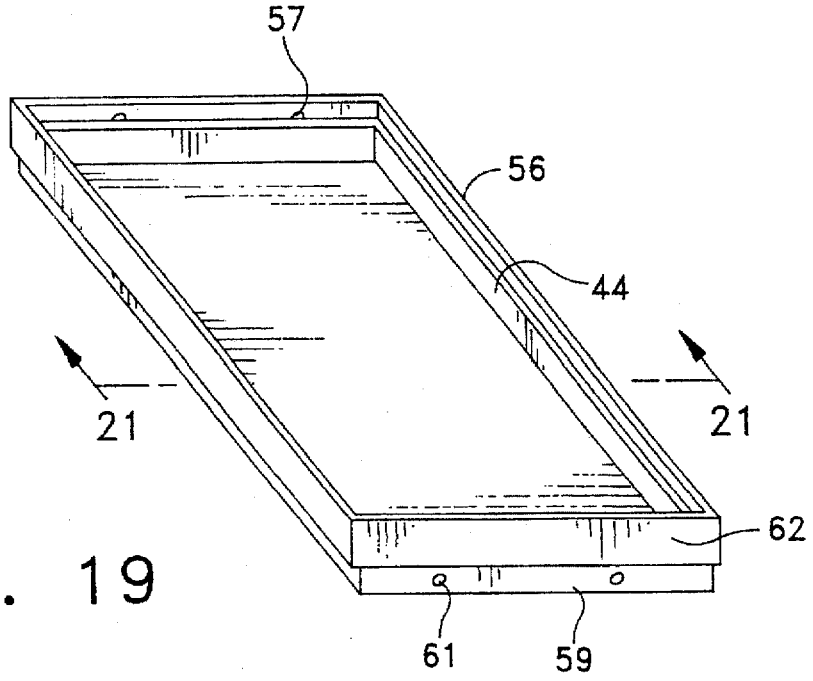
FIG. 19 is a perspective view of a slug tray extender.
Figure 20:
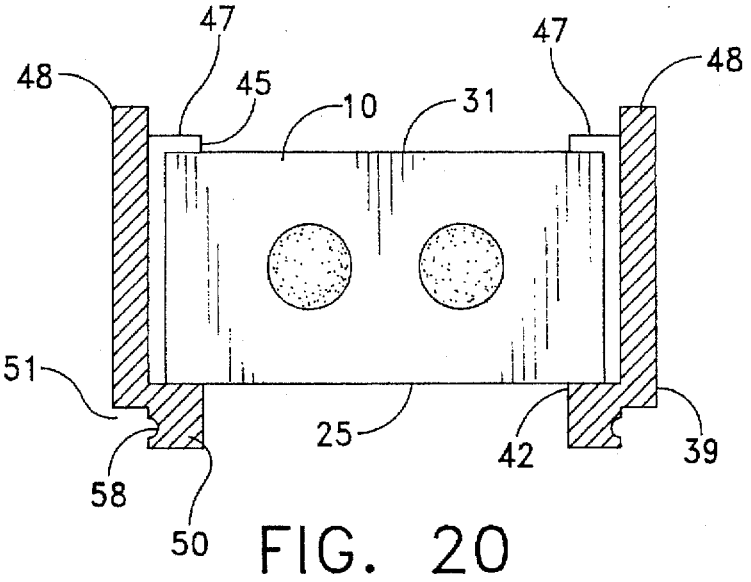
FIG. 20 is a sectional view of a slug tray with a slug, and two earrings on the slug for illustrative purposes only.
Figure 22:
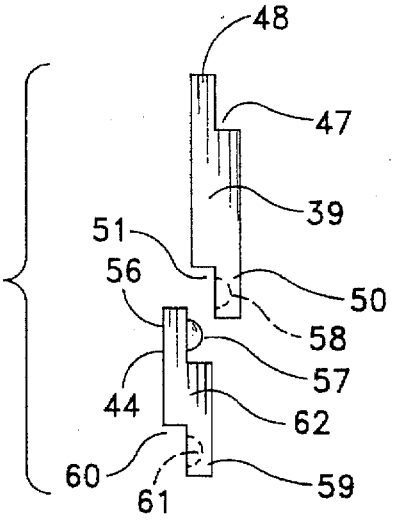
FIG. 22 is an enlarged cross-sectional detail of a slug tray and slug tray extender showing ridge and groove interlock.
Figure 23:
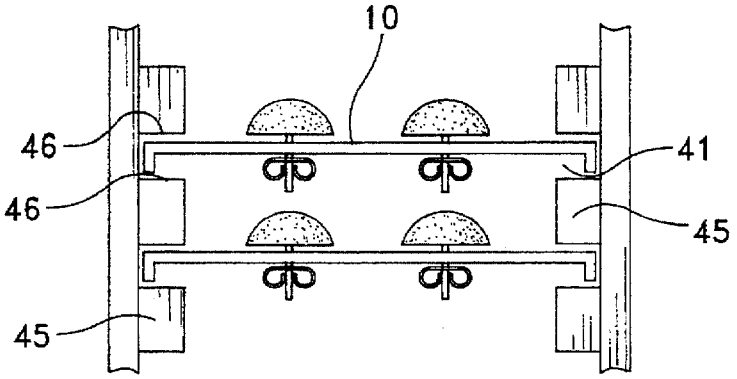
FIG. 23 is a sectional view of slug tray slots containing two slugs, showing a pair of earrings attached to each slug for illustrative purposes only.
Figure 24:
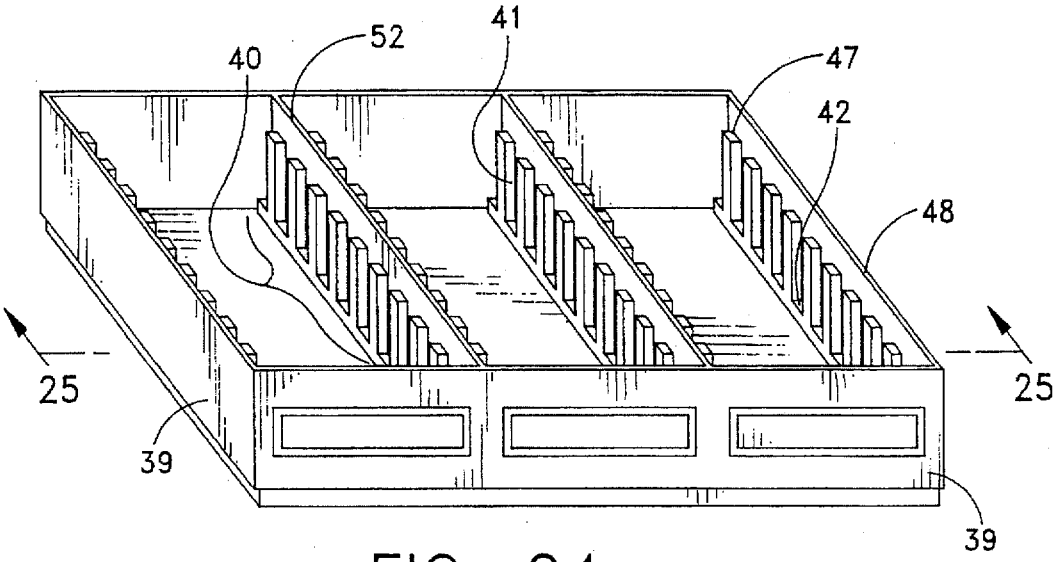
FIG. 24 is a perspective view of a slug tray with multiple rows of vertical slots in the slug tray.

The slug and slug holder can be used with or without the slug tray 38 shown in FIGS. 18 and 24. The slug tray is comprised of a frame 39 suitable for automated handling of one or more pairs of rows of flanges 40 forming vertical slots 41, slot bottoms 42, and as shown in FIGS. 20 and 22, interlocking means, 47, 48, 50, 51 when a slug tray is stacked on a slug tray, or 47, 48, 59 and 60 when a slug tray with extender is stacked on a slug tray, which interlocking means allows for the stable interlocking stacking of slug trays. The slug tray can be used with or without a slug tray extender 44, shown in FIGS. 19 and 25, which removably interlocks with the slug tray to permit varying the slug tray size to accommodate larger jewelry or similar articles that project below the slug bottom.

The slug tray frame is designated to be handled by automated or manual means. The frame ordinarily is made of molded plastic, but could be made of wood, metal, cardboard or similar materials and ordinarily would be rectangular or circular. The frame is dictated by the slug size and the economics of product handling. Automated handling equipment limitations also can influence tray size. Economic considerations include shipping costs, ease of handling by automated and manual means, use of standardized containers for shipping, and the volume of product to be handled in a similar manner. The frame has no top or bottom, which allows easy insertion and withdrawal of slug cards, and allows jewelry pieces that project below the slug bottom to hang freely, as described below.

Figure 26:
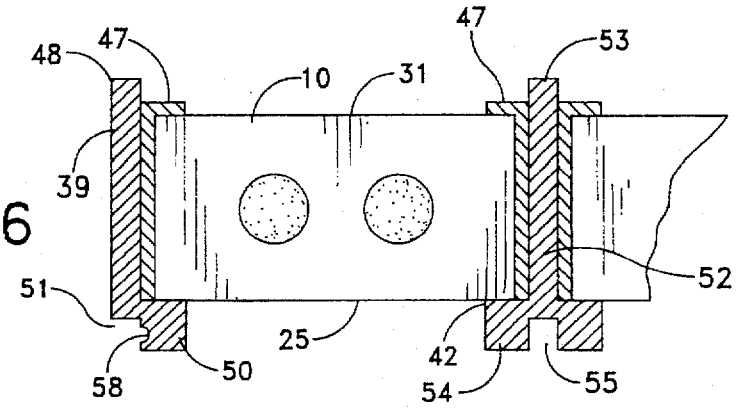
FIG. 26 is a sectional view of a multiple row slug tray showing a slug tray cross member.

Rows of flanges (40) are comprised of a plurality of tray flanges 45 and vertical slot sides 46 paired to create a plurality of vertical slots (41). The rows generally will be made of the same material as frame means, and may be molded with frame means as a single unit or attached to the frame means. Flange dimensions are dictated by the size of the slug and jewelry or other articles the slug tray is intended to hold. As shown in FIGS. 20 and 26, the flange should create a vertical slot that is taller from slot bottom (42) to the flange top (47) than a slug (10) is from the slug bottom (25) to the slug top (31) to prevent damage to the slug from stacking trays or general handling, but not so tall as to interfere with automated or manual removal of the slug from the slug tray, and not so large as to require unnecessarily large trays, which are heavier and more expensive to ship. A height difference between vertical slot and slug of approximately 1/32" to 3/8" generally is satisfactory.

The thickness of the tray flange (45) usually is dictated primarily by the size of the jewelry or other articles to be placed in the tray. The flange separates the vertical slots, and should be thick enough to prevent the pins, posts or other portions of jewelry protruding from a slug back from coming into contact with the jewelry attached to the next slug back in the vertical slots. Low cost slug trays can be custom designed for particular jewelry. Higher cost slug trays ordinarily are designed preferably to accommodate a wide range of jewelry designs and styles. Slug trays can accommodate jewelry protruding greater distances from the slug face or slug back by not filling adjacent vertical slots, but rather every second, third or more vertical slots. Costs of shipping, size of product, variability of size of product within a company's population of products and similar factors all influence determination of preferable flange thickness. Factors for currently popular jewelry items indicates that preferable flange thickness at this time ranges between ¼" to ⅝"

The spacing of the flanges determines the vertical slot width, which should be wide enough to permit easy insertion into and removal of slugs from vertical slots, but not so great as to permit slugs to move excessively in the vertical slot, or to fall out of the vertical slot in normal movement. Vertical slot widths slightly greater than the slug thickness to ¼" greater than slug thickness generally are preferable.

Spacing between two opposing rows of flanges of a pair of rows is also determined primarily by slug size. The slug should move easily within the vertical slot, but a vertical slot should not be so much wider than a slug that the slug falls out of the vertical slot.

The vertical slots include slot bottoms (42) so that the slugs will not fall out of the bottomless frame. Slot bottoms can be made of the same material and formed at the same time as rows of flanges. The flanges must be of size sufficient to keep the slug from falling out of the vertical slot, but not so great as to impinge on the area occupied by that portion of jewelry or other articles that hang below the slug bottom.

Stable stacking of slug trays facilitates economical, faster and more protective transport, distribution, storing and handling. As shown in FIGS. 20 and 22, a frame top ridge 48 projects above the flange top (47) to permit stable interlocking stacking of identical slug trays. A frame bottom ridge 50 with a recess 51 sized to fit the frame top ridge allows for stable interlocking stacking of slug trays. Ridges and the recess can have any of numerous cross sectional shapes, provided that when two slug trays are stacked, the slug tray on top can be lifted off the bottom slug tray without resistance from the ridges and recess. The ridges and recess can be made from the same material and formed at the same time as the frame and rows of flanges.

For slug trays with more than one pair of rows of flange (40), as shown in FIG. 24, a cross member 52 connected to and a part of the frame, supports two rows of flanges, one flange row that is part of a first pair of flange rows, and one flange row that is part of a second pair of flange rows. Cross members can be formed of the same material as, and simultaneous with, the other frame elements and rows of flanges, or can be formed separately. As shown in FIG. 26, cross members can include a top ridge 53 and a bottom ridge 54 with recess 55 sized to fit the cross member top ridge to permit stable interlocking stacking.

Figure 21:
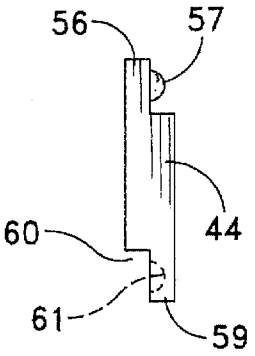
FIG. 21 is a sectional view of an extender.
Figure 25:
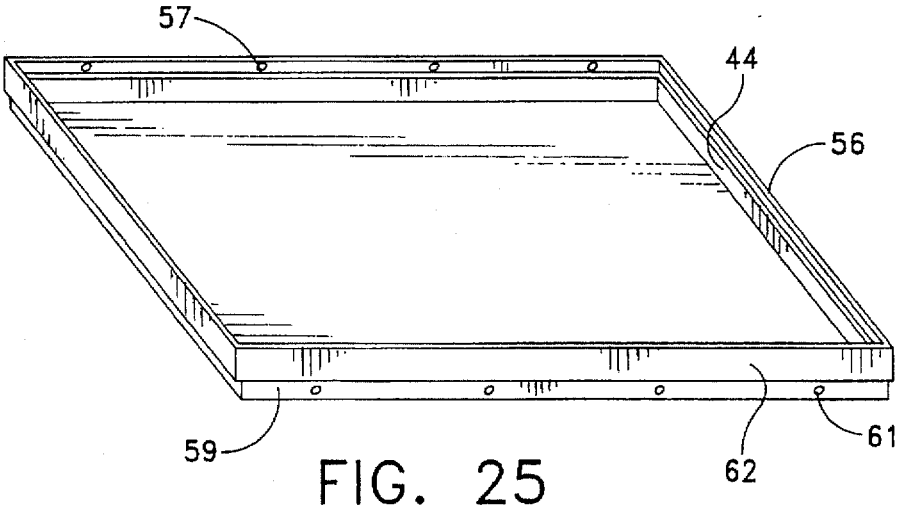
FIG. 25 is a perspective view of a slug tray extender for use with a slug tray consisting of multiple rows of vertical slots.

Some jewelry articles, such as certain styles of earrings, are larger than the slug, or when attached to the slug in an aesthetically pleasing manner, hang below the bottom edge of the slug. As shown in FIGS. 19, 21 and 25, the slug tray extender (44) has an extender top ridge 56 sized to fit the slug tray bottom ridge recess (51), with a snap 57 on the extender top ridge. Slug trays intended for use with an extender have bottom ridge recess dimples 58 located in the slug tray bottom ridge, and sized and spaced to accept slug tray extender snaps (57).

The extender also has a slug tray extender bottom ridge (59), with a extender recess 60 and extender recess dimple 61 identical in size and shape to the slug tray bottom ridge recess (55) and dimple (58), so that additional extenders may be added in succession to allow the frame to be increased to accommodate a variety of jewelry lengths. The extender top (56) and bottom (59) ridges are connected to opposing ends of an extender spacer 62. The extender height is selected by consideration of economics and product size. When other factors do not control extender size, and slug tray height has been selected to allow packing or handling in standardized sizes, it is preferable to make the extender height ½, ⅓, ¼ or similar fractional portions of the height of the slug tray so that when multiple slug trays with extenders are placed in standardized containers, the multiple slug trays with extenders are the same height as a greater number of slug trays without extenders. For example, if extenders are ½ of slug tray height, two slug trays each with an extender will occupy the same space as three slug trays without extenders.

Figure 27:
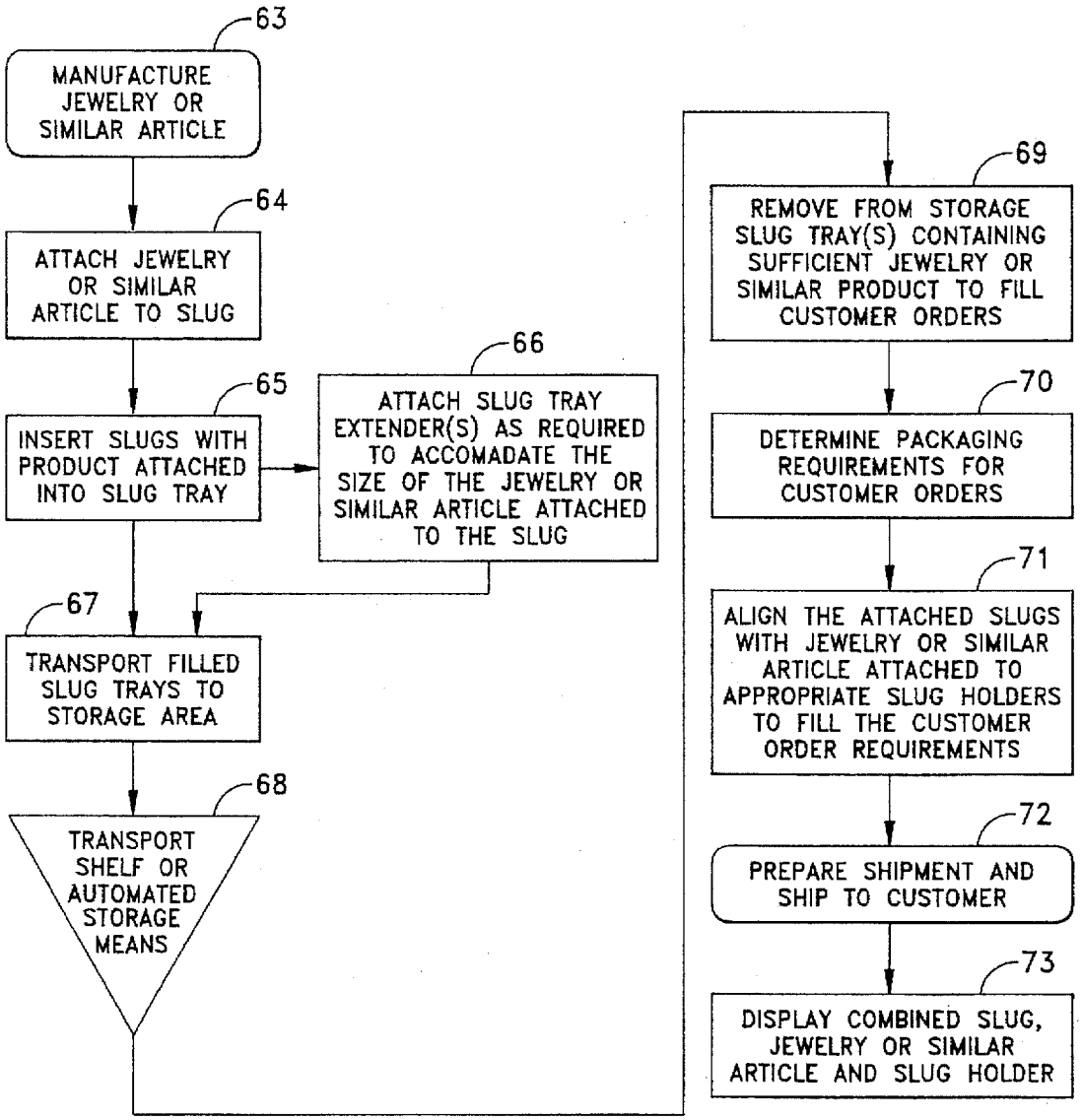
FIG. 27 is a flow chart of the slug, slug holder and slug tray distribution system.

The slug, slug holder and slug tray is an efficient method of storing, shipping and displaying jewelry and similar articles. As shown in FIG. 27, jewelry or a similar article 63 is attached 64 to a slug. The slug and article combination is inserted 65 in a slug tray, which may be increased in size by attaching 66 a slug tray extender. The slug and article combination, stored in a tray with or without an extender is transported to a storage area 67, and is stored by a traditional shelf or automated storage means 68. As orders are received, slug trays containing sufficient jewelry or similar articles to fill orders are removed from storage 69. Packaging requirements are determined based on customer orders 70. Combinations of slugs and jewelry or other articles are aligned with and attached to slug holders appropriately marked to fill customer orders 71. The combined slug, jewelry or other article and slug holder is prepared for shipment, shipped to the customer 72, and displayed in combination 73.

Figure 28:
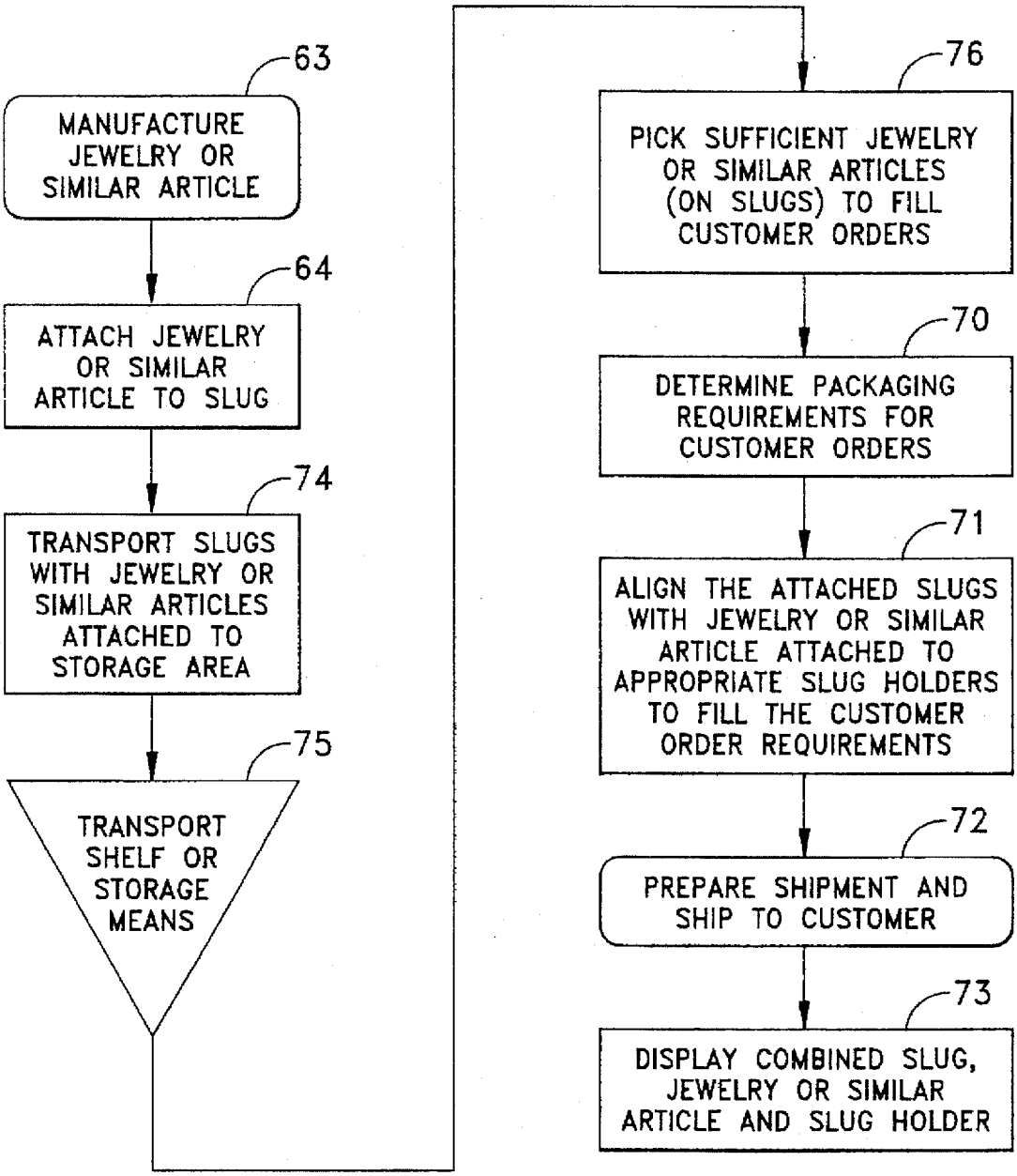
FIG. 28 is a flow chart of the slug and slug holder distribution system.

As shown in FIG. 28, a similar method uses the slug and slug holder, without the slug tray or slug tray extender. Jewelry or a similar article (63) is attached (64) to a slug. The slug and jewelry or similar article combination is transported 74 to a traditional shelf storage means 75, from which the combinations of slug and jewelry or similar articles are picked 76 to fill customer orders. As in the slug, slug holder and slug tray method, packaging requirements are determined (70), slugs with jewelry or similar articles are aligned and attached (71) to appropriate slug holders, and the combined slug, jewelry or other article and slug holder is prepared for shipment, shipped to the customer (72) and displayed as a combination (73).

I claim:

1. An apparatus for the distribution and display of jewelry and similar articles comprising in combination:

a. a generally planar rectangular slug having a slug face with a slug indicia display area, a slug back with an attachment area, a slug bottom, a slug top, and jewelry attachment means;

b. a generally planar rectangular slug holder larger than the slug and having a slug holder face with a slug holder indicia display area and a slug holder attachment area, a slug holder back, opposing side edges, a slug holder bottom, a slug holder top, and a product back projection area;

c. means for aligning the slug with the slug holder comprising a flange located on each of the opposing side edges projecting away from and approximately perpendicular to the slug back a distance approximately equal to the thickness of the slug holder, and a substantially flat work surface on which the slug bottom and slug holder bottom can be aligned; and d. one or more tape strips located between the slug holder face and the slug back for attaching the slug to the slug holder.

2. An apparatus for the distribution and display of jewelry and similar articles comprising:

a. a generally planar slug having a slug face with a slug indicia display area, a slug back with an attachment area, and jewelry attachment means;

b. a generally planar slug holder having a slug holder face with a slug holder indicia display area and a slug holder attachment area;

c. alignment means for aligning the slug with the slug holder so that the slug holder indicia display area extends beyond the periphery of the indicia display area of the slug; and d. attachment means for attaching the slug to the slug holder.

3. The apparatus of claim 2, said slug having opposing side edges, said slug holder having opposing side edges and a slug holder bottom, said alignment means comprising a flange located on each of the opposing side edges of the slug projecting away from and approximately perpendicular to the slug back, and a substantially flat work surface on which the slug bottom and slug holder bottom can be aligned.

4. The apparatus of claim 3, said alignment means comprising a tab on the slug, the flanges and tab projecting away from and approximately perpendicular to the slug back.

5. An apparatus for the display of articles comprising:

a generally planar slug including a body having a front surface with an indicia display area, and means for attaching the article to the body in a position that the article is displayed on the front surface of the body;

a generally planar slug holder adapted to attach the slug thereto, said slug holder including a body having a front surface with an indicia display area which extends beyond the periphery of the indicia display area of the slug upon attaching the slug to the slug holder;

alignment means associated with at least one of the slug and slug holder for aligning the slug with the slug holder; and attachment means associated with at least one of the slug and slug holder for attaching the body of the slug to the body of the slug holder.

6. The apparatus set forth in claim 5, said alignment means comprising a pair of flanges located on opposite side edges of the body of the slug, said flanges projecting rearwardly from a back surface of the body of the slug opposite the front surface and receiving the body of the slug holder therebetween when aligning the slug with the slug holder by said alignment means.

7. The apparatus set forth in claim 6, said alignment means further comprising a tab located along a bottom edge of the body of the slug and projecting away from the back surface of the body of the slug.

8. The apparatus set forth in claim 5, said alignment means comprising a jig, separate from the slug and the slug holder, for positioning the body of the slug relative to the body of the slug holder prior to the attachment of the slug to the slug holder by said attachment means.

9. The apparatus set forth in claim 5, said alignment means comprising a ridge projecting forwardly from the front surface of the body of the slug holder, and a recess formed in the body surface of the slug for receiving the ridge therein for aligning the slug with the slug holder.

10. The apparatus set forth in claim 5, said alignment means comprising at least one rail projecting from a back surface of the body of the slug, and at least one rail slot formed in the body of the slug holder, said rail, when received in the rail slot, aligning the slug with the slug holder.

11. The apparatus set forth in claim 5, said alignment means comprising at least one pin provided on one of the slug and the slug holder, and at least one pin hole formed in the other of the slug and slug holder, the pin, when received in the pin hole, aligning the slug with the slug holder.

12. The apparatus set forth in claim 11, said attachment means comprising a bulbous head provided on the pin for securing the slug to the slug holder when inserting the pin in the pin hole.

13. The apparatus set forth in claim 5, said attachment means comprising a two-sided adhesive strip disposed between the bodies of the slug and slug holder.

* * * * *